US010954672B2

(12) United States Patent
Abbas et al.

(10) Patent No.: US 10,954,672 B2
(45) Date of Patent: Mar. 23, 2021

(54) METHOD OF CONNECTING A CIRCULAR CONCRETE-FILLED STEEL TUBULAR COLUMN TO A REINFORCED CONCRETE FOOTING

(71) Applicant: KING SAUD UNIVERSITY, Riyadh (SA)

(72) Inventors: Husain Abbas, Riyadh (SA); Yousef A. Al-Salloum, Riyadh (SA); Tarek H. Almusallam, Riyadh (SA); Nadeem A. Siddiqui, Riyadh (SA); Baha M. A. Khateeb, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 16/706,593

(22) Filed: Dec. 6, 2019

(65) Prior Publication Data

US 2020/0208403 A1 Jul. 2, 2020

Related U.S. Application Data

(62) Division of application No. 16/233,755, filed on Dec. 27, 2018, now Pat. No. 10,563,402.

(51) Int. Cl.
*E04C 3/34* (2006.01)
*E04G 21/14* (2006.01)
(Continued)

(52) U.S. Cl.
CPC ..... *E04C 3/34* (2013.01); *E04C 3/32* (2013.01); *E04G 21/14* (2013.01); *E04C 3/30* (2013.01)

(58) Field of Classification Search
CPC ..... E04C 3/34; E04C 3/32; E04C 3/30; E04G 21/14
See application file for complete search history.

(56) References Cited

U.S. PATENT DOCUMENTS 426,924 A * 4/1890 Costigan ..... E04C 3/34 285/292.1
2,698,761 A * 1/1955 Claypool ..... E21B 17/06 285/3

(Continued)

FOREIGN PATENT DOCUMENTS

JP 04285211 A 10/1992

OTHER PUBLICATIONS

Lehman et al., "Foundation connections for circular concrete-filled tubes," Journal of Constructional Steel Research, vol. 78, Nov. 2012, pp. 212-225.

*Primary Examiner* — Basil S Katcheves
*Assistant Examiner* — Omar F Hijaz
(74) *Attorney, Agent, or Firm* — Nath, Goldberg & Meyer; Richard C. Litman

(57) ABSTRACT

The method of connecting a circular concrete-filled steel tubular column to a reinforced concrete footing provides a process for constructing a circular concrete-filled steel tubular column anchored in a reinforced concrete footing. A tubular member is partially embedded in a cavity formed in a block of reinforced concrete, such that a pair of flanges thereof is positioned adjacent to and above a base surface of the cavity. A steel tube is partially inserted into the cavity, such that rotation of the steel tube will cause the pair of flanges to interlock with a pair of slots at the lower end of the steel tube, locking the steel tube in place with respect to the tubular member and the block of reinforced concrete. The cavity is filled with concrete grout to secure the column, and the steel tube is filled with concrete to form the circular concrete-filled steel tubular column.

2 Claims, 8 Drawing Sheets

(51) Int. Cl.
*E04C 3/32* (2006.01)
*E04C 3/30* (2006.01)

(56) References Cited

U.S. PATENT DOCUMENTS

| | | | | |
|---|---|---|---|---|
| 3,913,953 | A | 10/1975 | Archer | |
| 5,012,622 | A | 5/1991 | Sato et al. | |
| 5,492,429 | A | 2/1996 | Hodges | |
| 5,826,387 | A | 10/1998 | Henderson et al. | |
| 8,549,812 | B1 * | 10/2013 | Peng | E04B 1/34305 212/348 |
| 2004/0040224 | A1 | 3/2004 | Dayton | |
| 2015/0225917 | A1 | 8/2015 | Goto | |

* cited by examiner

METHOD OF CONNECTING A CIRCULAR CONCRETE-FILLED STEEL TUBULAR COLUMN TO A REINFORCED CONCRETE FOOTING

CROSS REFERENCE TO RELATED APPLICATION

This application is a divisional of application Ser. No. 16/233,755, filed Dec. 27, 2018, now issued.

BACKGROUND

1. Field

The disclosure of the present patent application relates to construction techniques, and particularly to a method and system for connecting a circular concrete-filled steel tubular (CFST) column to a reinforced concrete (RC) footing.

2. Description of the Related Art

Concrete-filled steel tubes (CFSTs) are structural members for carrying heavy loads and are often used as piers in bridges and as columns in high-rise buildings. The steel tubes serve as formwork and reinforcement for the concrete fill, eliminating the need for flexible reinforcing cages, shoring and temporary formwork, as well as increasing safety and reducing labor costs, which consequently speeds up construction. The steel tube provides confinement and shear strength to the concrete fill, thus increasing the load carrying capacity of the CFST columns. Further, the use of CFST columns provides large economic savings by increasing the usable floor area through a reduction in the required cross-sectional size. This latter consideration is very important in the design of high-rise buildings in cities, where the cost of letting spaces is extremely high.

One of the most challenging problems in the adoption of CFSTs in construction is related to the connection detailing between CFST columns with other structural members, particularly the foundation. Although several types of connections are presently employed, there remains a need for connections that can be integrated with precast elements, which are also able to develop the strength and stiffness required for carrying gravity loads, as well as the large ductility cycles required for seismic designs. Thus, a method of connecting a circular concrete-filled steel tubular column to a reinforced concrete footing solving the aforementioned problems is desired.

SUMMARY

The method of connecting a circular concrete-filled steel tubular column to a reinforced concrete footing provides a process for constructing a circular concrete-filled steel tubular column anchored in a reinforced concrete footing. A block of reinforced concrete having opposed top and bottom surfaces has a cavity formed therein. The cavity has an open upper end, a closed lower base surface, and at least one sidewall defined within the block of reinforced concrete. The open upper end of the cavity is contiguous with the top surface of the block of reinforced concrete and has an elliptical contour. The closed lower base surface is circular, such that the length of a major axis of the elliptical upper opening of the cavity is equal to the diameter of the circular base of the cavity. The at least one sidewall may have a corrugated internal surface.

A tubular member is partially embedded in the block of reinforced concrete at the base of the cavity. The tubular member has a cylindrical sidewall and open upper and lower ends, and further includes at least one pair of diametrically opposed flanges mounted on the open upper end, extending radially outward therefrom. The tubular member is embedded in the block of reinforced concrete such that the at least one pair of diametrically opposed flanges are raised slightly above the base of the cavity.

The column is a steel tube having a cylindrical sidewall. An elliptical base plate is mounted, e.g., by welding, on the open lower end of the cylindrical column. The elliptical base plate has a central circular opening aligned with and in open communication with the open lower end of the cylindrical sidewall of the column. At least one pair of diametrically opposed flange slots or brackets project from the lower surface of the elliptical base plate. The length of the major axis of the elliptical base plate is equal to the length of the major axis of the elliptical opening of the upper end of the cavity.

After hardening of the reinforced concrete block forming the footing, the base of the steel tube column is inserted into the cavity in the reinforced concrete footing such that the at least one pair of diametrically opposed flange slots are positioned circumferentially adjacent to the at least one pair of diametrically opposed flanges. The steel tube is then rotated about its axis so that the at least one pair of diametrically opposed flanges interlock with the at least one pair of flange slots projecting from the column's elliptical base plate. This rotation locks the steel tube in place with respect to the tubular member embedded in the footing. The cavity is then filled with concrete grout, and the steel tube is filled with concrete to form the circular concrete-filled steel tubular column.

These and other features of the present invention will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
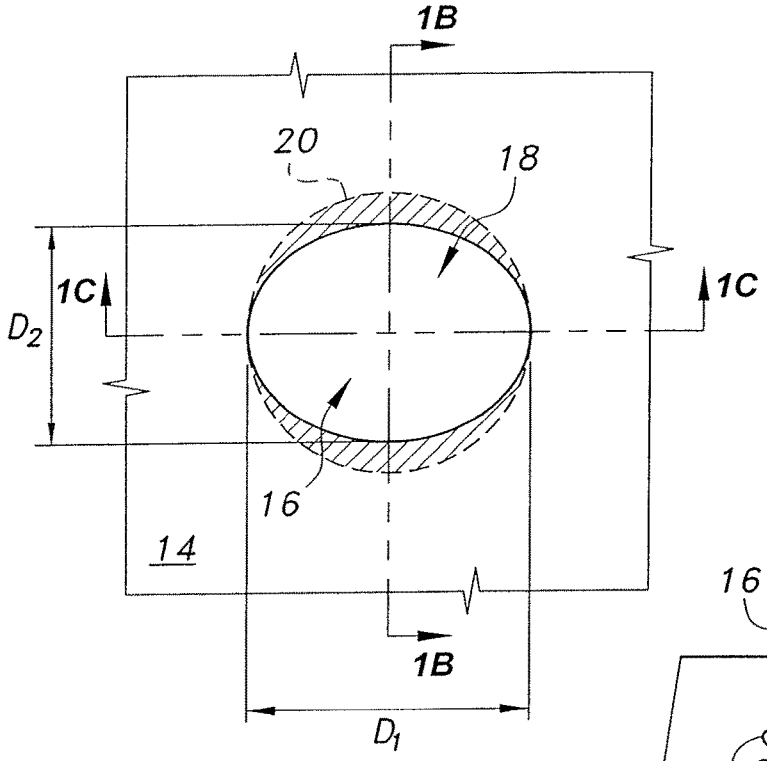
FIG. 1A is a top view of a reinforced concrete footing for use in a method of connecting a circular concrete-filled steel tubular column to a reinforced concrete footing shown before first-stage concreting, the footing being a block of reinforced concrete having a cavity formed therein.
Figure 1B:
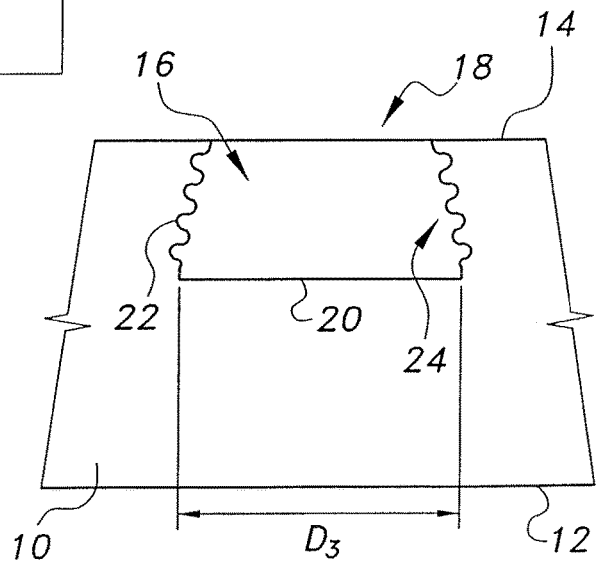
FIG. 1B is a section view taken along lines 1B-1B of FIG. 1A.
Figure 1C:
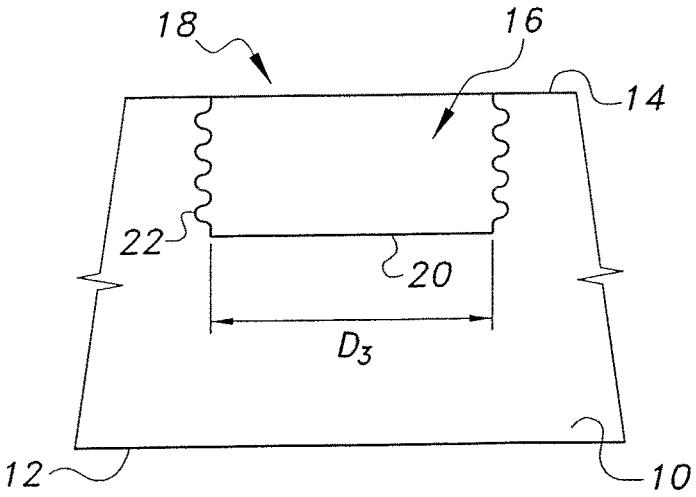
FIG. 1C is a section view taken along lines 1C-1C of FIG. 1A.

The method of connecting a circular concrete-filled steel tubular (CFST) column to a reinforced concrete footing provides a process for constructing a circular concrete-filled steel tubular column anchored in a reinforced concrete footing. As shown by the forms for the reinforced concrete footing in FIGS. 1A-1C, the footing will have opposed bottom and top surfaces 12, 14, respectively, and a cavity 16 formed therein. The cavity 16 will have an open upper end 18, a closed lower base surface 20, and at least one sidewall 22. As shown in FIGS. 1B and 1C, the at least one sidewall may have a corrugated internal surface 24 for increasing the pullout interface shear, and thus the bending moment, to secure the base of the column in the footing. The open upper end 18 of cavity 16 is contiguous with the top surface 14 of the footing and has an elliptical contour. As shown in FIG. 1A, the elliptical contour of open upper end 18 has a major axis with length $D_1$ and a minor axis with length $D_2$. The closed base 20 of the cavity 16 is circular, and the length $D_1$ of the major axis of the open upper end 18 is equal to the diameter $D_3$ of the circular base 20 of the cavity 16.

The major axis of open upper end 18 is aligned with the axis of maximum column moment. Rebars on the cavity surface (i.e., rebars embedded within the reinforced concrete footing in the surface defining the cavity 16) are formed in the shape of the cavity 16, which may be achieved by leaving a uniform clear cover on the surface of the cavity 16. In the cavity 16, the transition from the elliptical open upper end 18 to the circular, closed lower base 20 can be made in the reinforced concrete footing by using retrievable forms. The depth of the cavity 16 may vary from 50% to 150% of the outer diameter of the circular CFST column, depending upon the connection design. However, it should be understood that other geometries may be utilized. For example, the elliptical contour of the open upper end 18 may be replaced by a rectangular contour with rounded corners. In this case, the diameter of the circular closed base surface 20 would be equal to the length of the rectangle defining the open upper end 18.

Figure 2A:
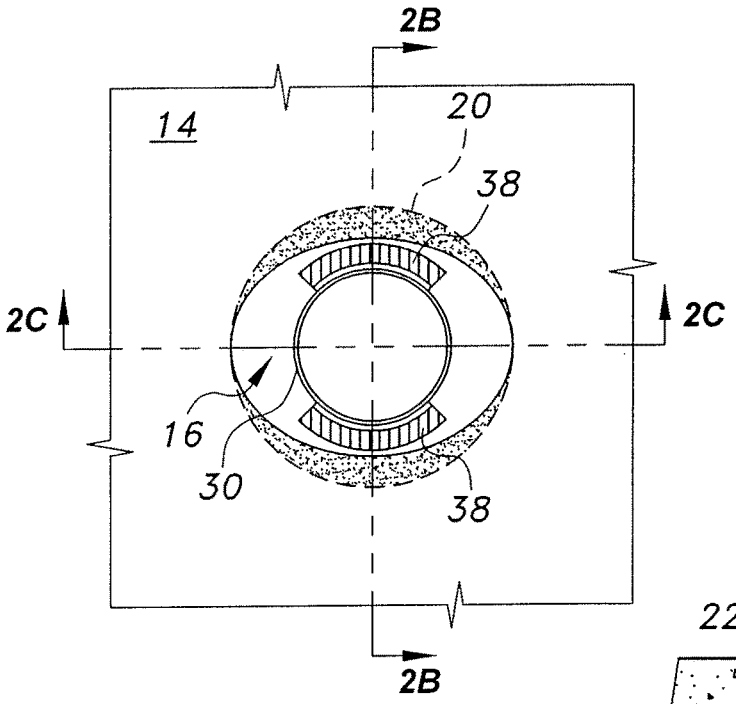
FIG. 2A is a top view of the reinforced concrete footing of FIG. 1A after embedding metal tube with quadrant flanges in concrete in the base of the cavity.
Figure 2B:
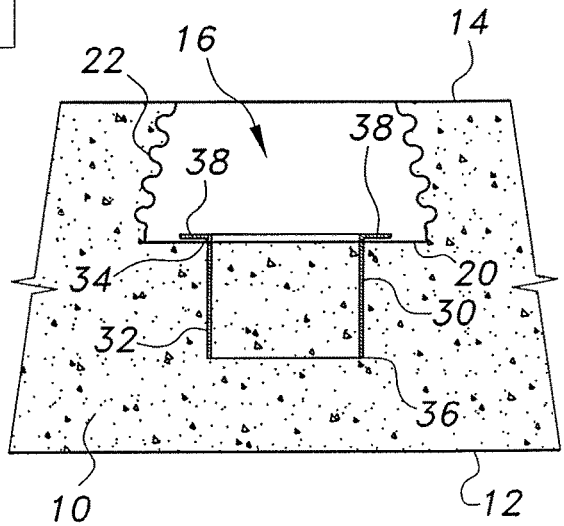
FIG. 2B is a section view taken along lines 2B-2B of FIG. 2A.
Figure 2C:
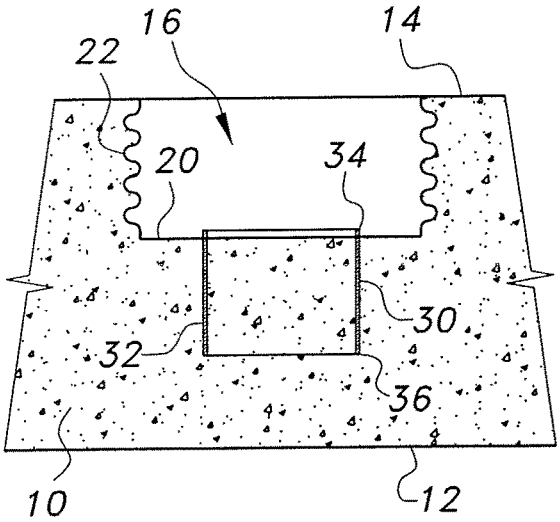
FIG. 2C is a section view taken along lines 2C-2C of FIG. 2A.
Figure 3:
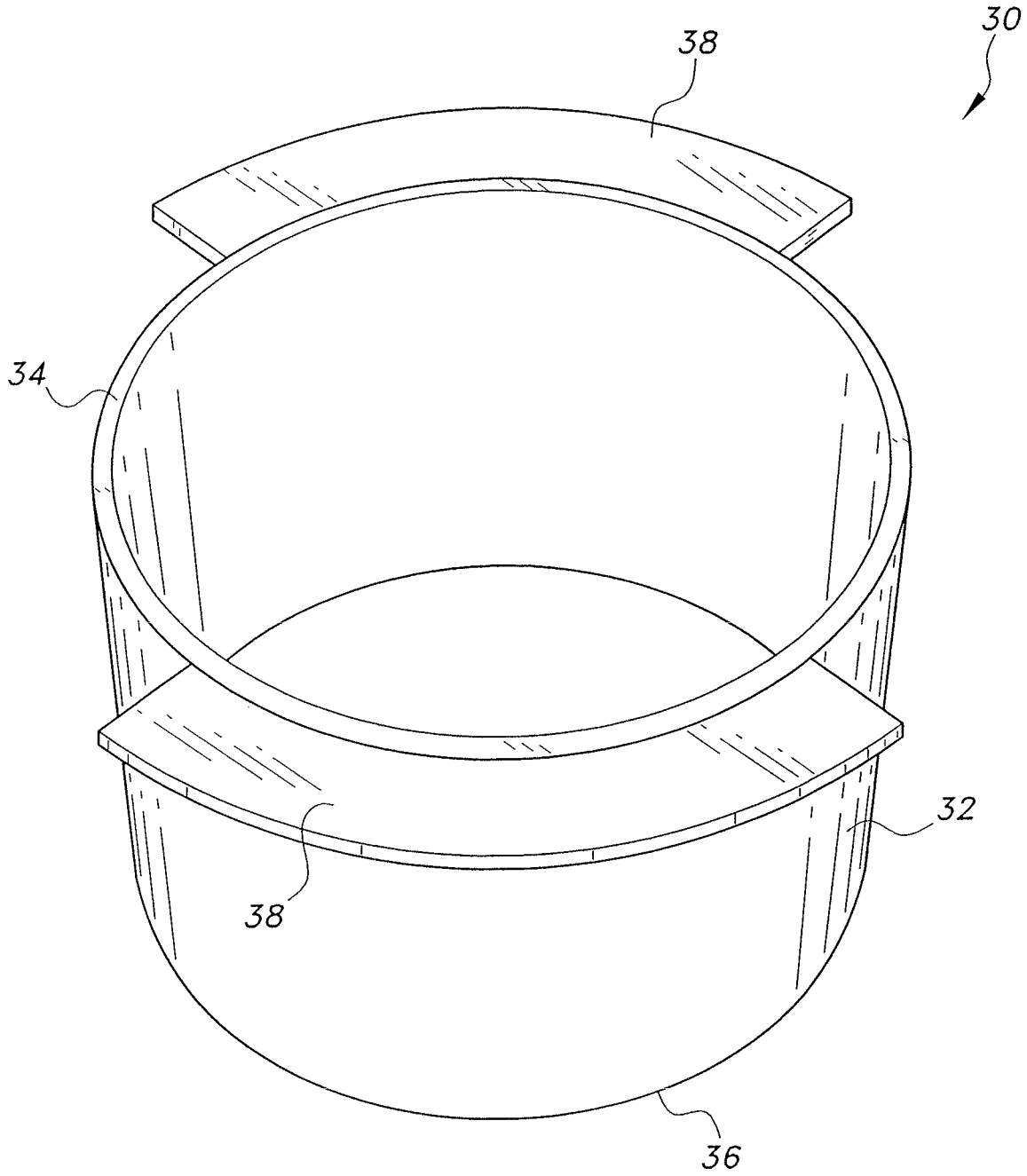
FIG. 3 is a perspective view of the tubular member embedded at the base of the cavity of the reinforced concrete footing.

As shown in FIGS. 2A-2C, a tubular member 30 is partially embedded in the block of reinforced concrete 10 defining the footing. As best shown in FIG. 3, the tubular member 30 has a cylindrical sidewall 32 and open upper and lower ends 34, 36, respectively. At least one pair of diametrically opposed flanges 38 are mounted on the open upper end 34 and extend radially outward therefrom. The flanges 38 shown in FIG. 2A are quadrant flanges, subtending an arc of 90° measured from the center of the cavity 16, and extend from the tubular member 30 on opposite sides of the major axis of the elliptical opening 18 (as shown in FIG. 1A), being bisected by a plane extending through the minor axis of the elliptical opening. Returning to FIGS. 2A-2C, the tubular member 30 is embedded in the block of reinforced concrete 10 such that the at least one pair of diametrically opposed flanges 38 are raised slightly above the closed lower base 20 of the cavity 16, about the thickness of the steel plate of flange slots or brackets 52 (or flanges 38, if same thickness of plate is used). In FIGS. 2A-2C and 3, a single pair of flanges 38 are shown, each spanning approximately 90° of arc. It should be understood that multiple pairs of flanges 38 may be mounted on and about open upper end 34. For example, six such flanges may be used, rather than the exemplary single pair of flanges 38 shown in FIGS. 2A-2C and 3. The radial length of each flange 38 may vary from 10% to 25% of the outer diameter of the cylindrical sidewall 32 of the tubular member 30. The length of the minor axis $D_2$ of the elliptical contour of open upper end 18 of cavity 16 (FIGS. 1A-1C) is slightly more (by about twice the thickness of plate used for making flange slots 52) than the outer diameter of the pair of flanges. Further, in order to provide additional securement between the tubular member 30 and the reinforced concrete block 10, the lower end 36 of tubular member 30 may also be provided with flanges, anchoring members or the like. Further examples of anchoring for the tubular member 30 include shear studs welded to the inner or outer faces of cylindrical sidewall 32 (or both faces), and/or forming perforations in the cylindrical sidewall 32.

Figure 4:
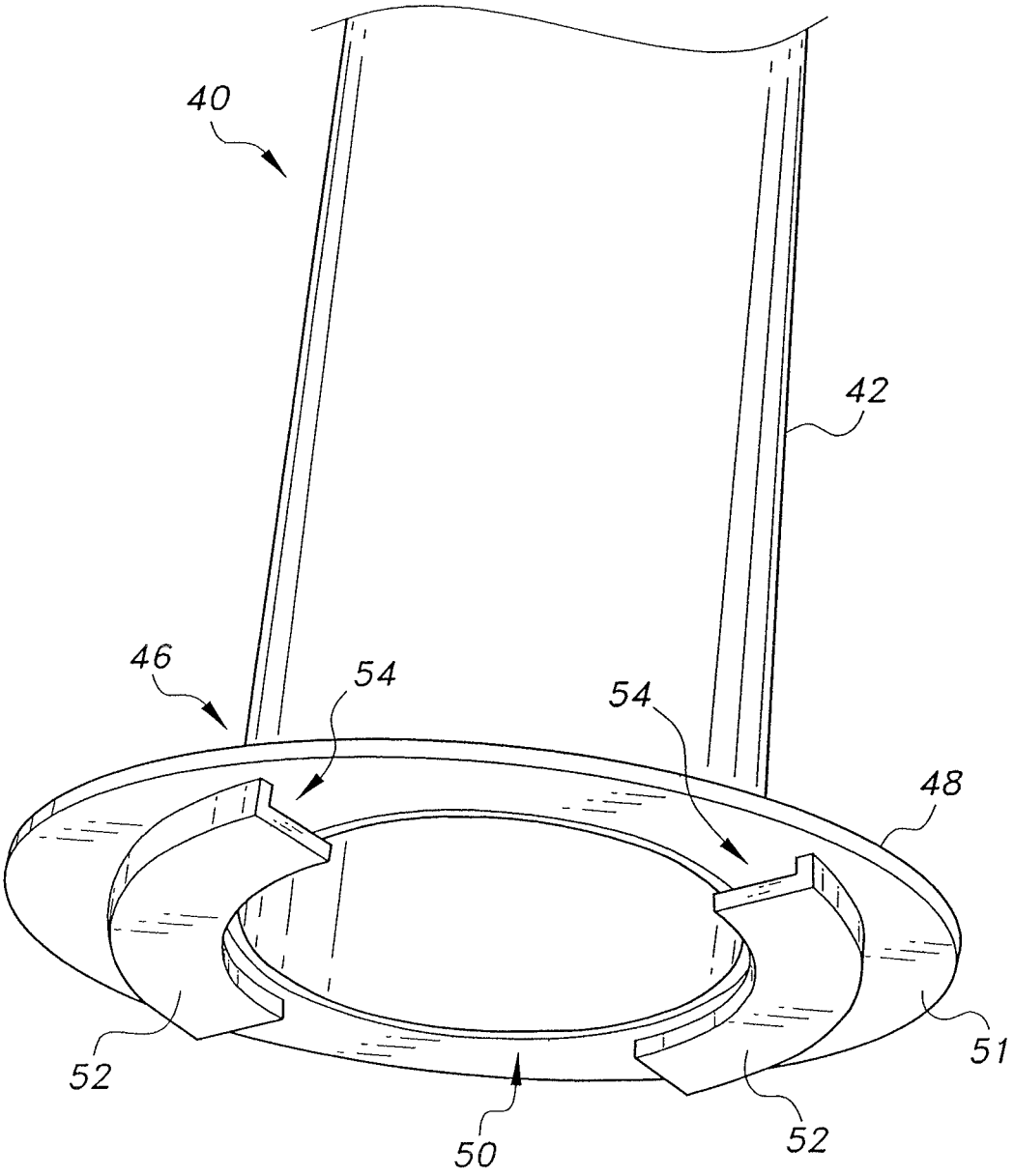
FIG. 4 is a partial perspective view of a circular steel tubular column used in the method of connecting a circular concrete-filled steel tubular column to a reinforced concrete footing, showing the base plate welded to the base of the column and the flange slots projecting therefrom.
Figure 5A:
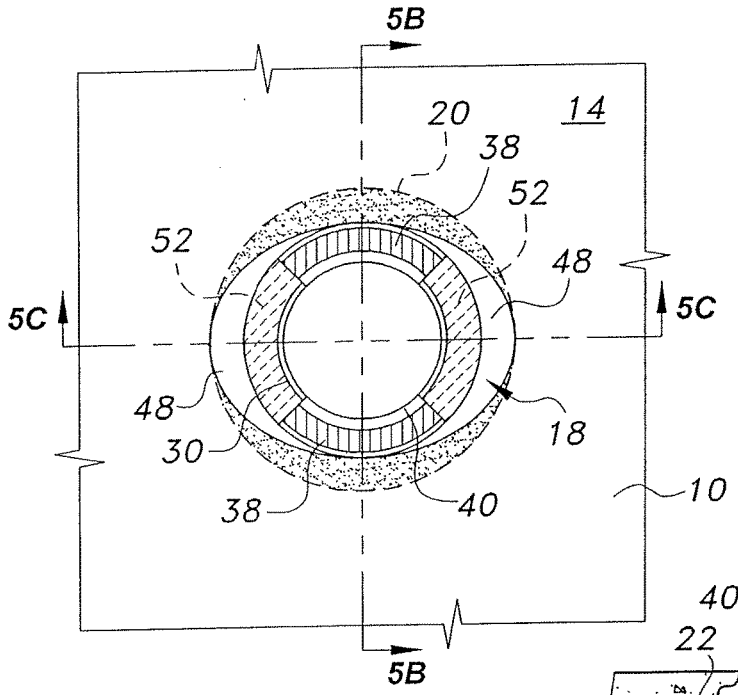
FIG. 5A is a top view of the reinforced concrete footing after hardening of the first-stage concrete and insertion of the base of the tubular column into the cavity.
Figure 5B:
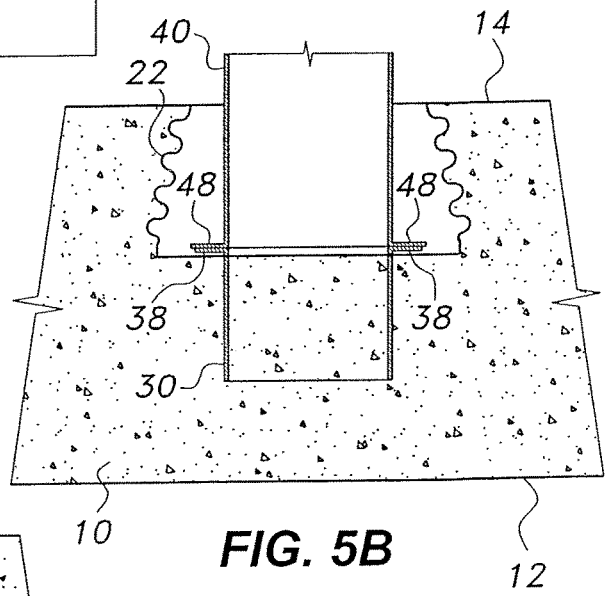
FIG. 5B is a section view taken along lines 5B-5B of FIG. 5A.
Figure 5C:
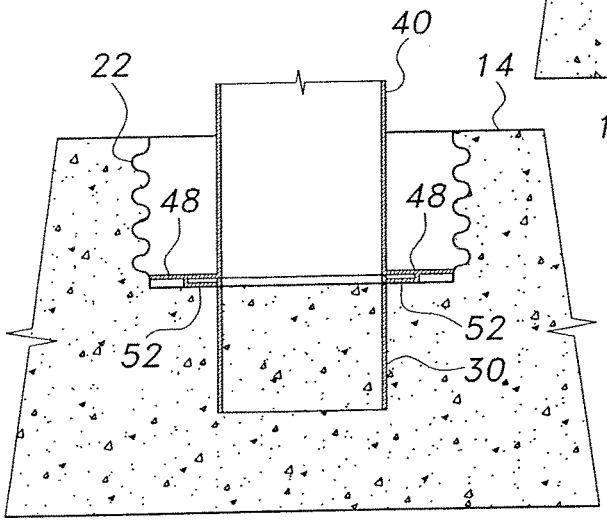
FIG. 5C is a section view taken along lines 5C-5C of FIG. 5A.

As shown in FIG. 4, the column is a steel tube 40 having a cylindrical sidewall 42 and an elliptical base plate 48 mounted (welded) on the base or open lower end 46 of the cylindrical sidewall 42. The diameter of tubular member 30 (FIG. 3) is equal to the diameter of steel tube 40. The tubular member 30 may also be cut from steel tube 40. The elliptical base plate 48 has a central circular opening 50 in open communication with and the same diameter as the open lower end 46 of the cylindrical sidewall 42. At least one pair of diametrically opposed brackets or flange slots 52 project from, and are welded to, the lower surface 51 of the elliptical base plate 48, such that the at least one pair of brackets 52 define at least one pair of slots 54. The flange slots or brackets 52 are bisected by the major axis of the elliptical base plate 48. The length of the major axis of the elliptical base plate 48 is equal to the length $D_1$ of the major axis of the elliptical contour of the open upper end 18 of cavity 16, allowing the base plate 48 to be inserted through the elliptical open upper end 18, as shown in FIGS. 5A-5C. The outer diameter of the pair of brackets 52 is equal to the length $D_2$ of the minor axis of the elliptical contour of the open upper end 18 of cavity 16. The inner diameter of the pair of flange slots is equal to the outer diameter of the pair of flanges 38 (FIGS. 2A-2C). The length $D_1$ of the major axis of the elliptical contour of the open upper end 18 of cavity 16 is such that the radial projection of the elliptical base plate 48 from sidewall 42 along major axis varies from 30% to 60% of the outer diameter of the cylindrical sidewall 42 of the tubular member 40.

After hardening of the reinforced concrete block, the steel tube 40 is partially inserted into cavity 16 such that the at least one pair of diametrically opposed flange slots 52 are positioned circumferentially adjacent to and below the at least one pair of diametrically opposed flanges 38. As noted above, only a single exemplary pair of flanges 38 is shown, although multiple pairs of such flanges may be provided. The number of pairs of flanges selected should match the number of flange slots or brackets 52 mounted on the lower surface of the base plate 48. For example, if three pairs of flanges 38 are provided on tubular member 30, then a corresponding three pairs of flange slots or brackets 52 (defining three corresponding slots 54) will be mounted to the lower surface 51 of elliptical base plate 48.

Figure 6A:
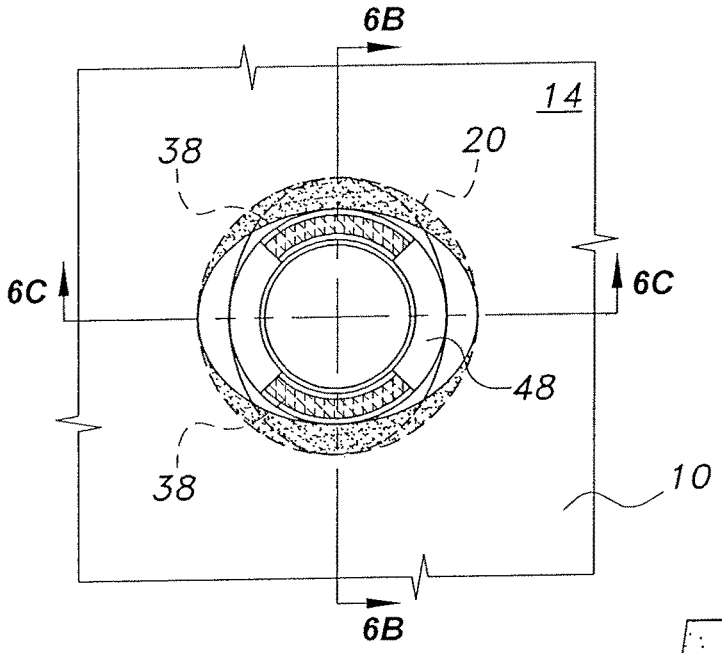
FIG. 6A is a top view of the reinforced concrete footing after 90° rotation of the circular steel tubular column.
Figure 6B:
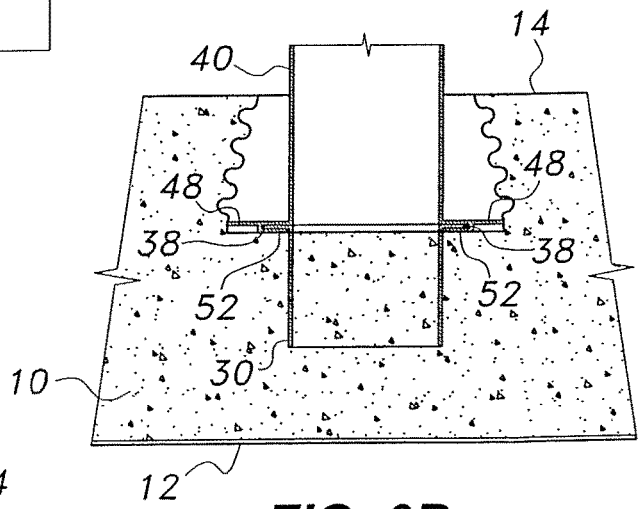
FIG. 6B is a section view taken along lines 6B-6B of FIG. 6A.
Figure 6C:
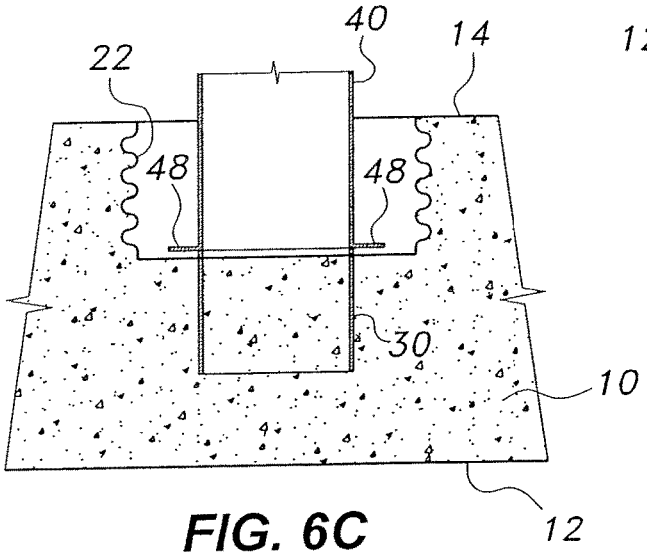
FIG. 6C is a section view taken along lines 6C-6C of FIG. 6A.
Figure 7:
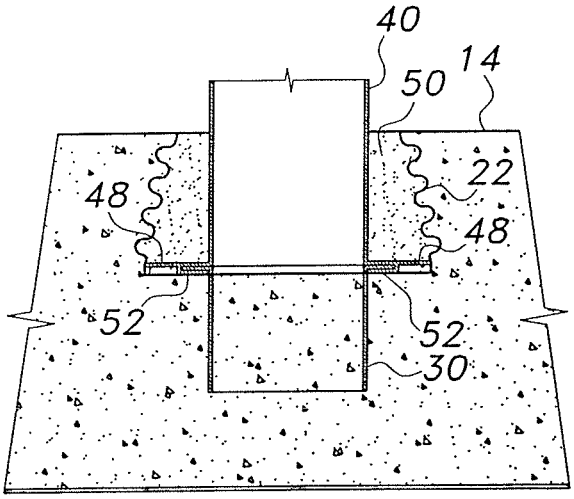
FIG. 7 is a partial side view in section of the reinforced concrete footing and the circular steel tubular column inserted therein after filling the cavity with concrete grout.
Figure 8:
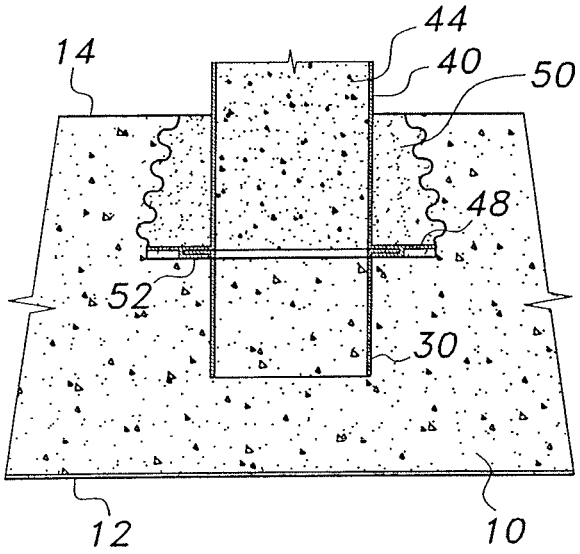
FIG. 8 is a partial side view in section of the reinforced concrete footing and the circular steel tubular column inserted therein after filling the column with concrete.

As shown in FIGS. 6A-6C, the steel tube 40 is then rotated about its axis such that the at least one pair of diametrically opposed flanges 38 interlock with the at least one pair of slots 54 defined by the at least one pair of diametrically opposed flange slots or brackets 52. This rotation locks the steel tube 40 in place with respect to the tubular member 30 and the reinforced concrete block 10, the flanges 38 resisting rotation of the column about the major axis of the elliptical opening 18 of the cavity 16. However, the rotation of the column about the minor axis will also be resisted, but the resistance will be less than that about the major axis. The use of multiple pairs of flanges, along with the matching number of flange slots or brackets 52 mounted on the lower surface of the base plate 48, will be useful when the bending moment about the minor axis is also large (i.e., in the case of biaxial bending), since it improves the moment resisting capacity about the minor axis. The cavity 16 is then filled with non-shrinking concrete grout 50, as shown in FIG. 7, to further secure the column 40 in the footing 10. After the non-shrinking concrete grout 50 is hardened, the steel tube 40 is filled with concrete 44, as shown in FIG. 8, to form the circular concrete-filled steel tubular column. It should be noted that FIGS. 7 and 8 show sections along the minor axis of the elliptical contour of open upper end 18 of cavity 16.

The bending of the CFST column under the action of lateral loads creates a force that tries to pull the circular CFST column out of the cavity 16. The above-described connection resists this pull, providing moment-resisting capacity to the column base through the mechanical interlock between the mating steel flanges 38 of the tubular member 30 and the slots 54 of the flange slots or brackets 52, which are welded underneath the elliptical base plate 48. This interlocking contributes significantly in resisting the column moments.

Further, even after a potential failure of the mechanical interlock (or severe deformation in the interlocking elements), the elliptical column base plate cannot be removed because the concrete grout 50 resists upward movement due to the negatively sloping interface between the reinforced concrete 10 and concrete grout 50, i.e., the sloping transition created by the elliptical open upper end 18 to the closed lower base 20, and their respective diameters, prevents concrete grout 50 from being drawn out of cavity 16. Further, as noted above, the corrugated interface between the reinforced concrete 10 and the cement grout 50, created by corrugation of sidewall 22, also resists the upward push of the cement grout 50.

In the above, it should be noted that proper clearances must be maintained between the coupling members for their free movement, although it is important to note that the clearances should not be too loose in order to avoid large slackness. Further, it should be noted that, as an alternative, the cavity, as described above, may be substantially cylindrical, allowing the corresponding column base plate to be circular rather than elliptical. As a further alternative, the flange-based interlocking connection may be removed altogether, thus removing the need for embedding the small steel tube in the first-stage concrete of the reinforced concrete footing. In this alternative, there would, correspondingly, be no need for the flange slots to be welded to the base plate of the steel tubular column. The column moment (i.e., bending) in this case would be resisted by the resistance provided by the negative slope of the cavity against pulling-off of the elliptical base plate.

It is to be understood that the method of connecting a circular concrete-filled steel tubular column to a reinforced concrete footing is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A method of connecting a circular concrete-filled steel tubular column to a reinforced concrete footing, comprising the steps of:

providing a reinforced concrete footing comprising a block of reinforced concrete having opposed top and bottom surfaces;

forming a cavity in the block of reinforced concrete, the cavity having an open upper end, a closed lower base, and at least one sidewall within the block of reinforced concrete, the upper end of the cavity being contiguous with the top surface of the block of reinforced concrete and having an elliptical opening, and the closed lower base being circular, the elliptical opening of the upper end of the cavity defining a major axis having a length, the circular base having a diameter equal in length to the length of the major axis of the elliptical opening;

partially embedding a tubular member in the block of reinforced concrete at the base of the cavity, the tubular member having a cylindrical sidewall and open upper and lower ends, and further having at least one pair of diametrically opposed flanges mounted on the open upper end and extending radially outward therefrom, the flanges being raised above the base of the cavity;

providing a column comprising a steel tube having a cylindrical sidewall and an elliptical base plate mounted on an open lower end of the cylindrical sidewall of the steel tube, the elliptical base plate having a central circular opening in open communication with the open lower end of the cylindrical sidewall and at least one pair of diametrically opposed brackets projecting from the elliptical base plate, the at least one pair of brackets defining at least one pair of flange slots, the elliptical base plate having a major axis equal in length to the length of the major axis of the elliptical opening of the cavity;

partially inserting the steel tube into the cavity of the block of reinforced concrete such that the at least one pair of diametrically opposed brackets are positioned circumferentially adjacent to and below the at least one pair of diametrically opposed flanges;

rotating the steel tube about an axis thereof such that the at least one pair of diametrically opposed flanges interlock with the at least one pair of slots defined by the at least one pair of diametrically opposed brackets so that the steel tube is locked in place with respect to the tubular member;

filling the cavity with concrete grout to secure the column in the reinforced concrete footing; and filling the column with concrete to form a circular concrete-filled steel tubular column.

2. The method of connecting a circular concrete-filled steel tubular column to a reinforced concrete footing as recited in claim 1, wherein the at least one sidewall defining the cavity has a corrugated internal surface.

* * * * *